US010544010B2

(12) United States Patent
Bosshart et al.

(10) Patent No.: US 10,544,010 B2
(45) Date of Patent: Jan. 28, 2020

(54) METHOD AND SYSTEM FOR ELEVATOR DOOR LOCKING AND DETECTION OF ELEVATOR DOOR LOCKING STATE

(71) Applicant: G.A.L. Manufacturing Company, LLC, Bronx, NY (US)

(72) Inventors: Stephen Bosshart, New York, NY (US); Andrew Goodwin, New York, NY (US)

(73) Assignee: G.A.L. Manufacturing Company, LLC, Bronx, NY (US)

( * ) Notice: Subject to any disclaimer, the term of this patent is extended or adjusted under 35 U.S.C. 154(b) by 324 days.

(21) Appl. No.: 15/711,101

(22) Filed: Sep. 21, 2017

(65) Prior Publication Data

US 2019/0084806 A1 Mar. 21, 2019

(51) Int. Cl.

| | |
|---|---|
| ***B66B 13/12*** | (2006.01) |
| ***B66B 13/16*** | (2006.01) |
| ***B66B 13/30*** | (2006.01) |

(52) U.S. Cl.

CPC ..... *B66B 13/16* (2013.01); *B66B 13/12* (2013.01); *B66B 13/30* (2013.01)

(58) Field of Classification Search

CPC ..... B66B 3/12; B66B 3/16; B66B 3/30

USPC ..... 187/247, 277, 310, 316, 317, 330–335, 187/391, 393; 49/116, 120

See application file for complete search history.

(56) References Cited

U.S. PATENT DOCUMENTS

| | | | | | |
|---|---|---|---|---|---|
| 3,912,049 | A * | 10/1975 | Holland | B66B 13/12 | 187/308 |
| 4,926,975 | A * | 5/1990 | Morris | B66B 13/12 | 187/324 |
| 5,005,673 | A * | 4/1991 | Rivera | B66B 13/12 | 187/319 |
| 5,105,916 | A * | 4/1992 | Steacy | B66B 13/12 | 187/319 |
| 5,427,204 | A * | 6/1995 | Salmon | B66B 13/20 | 187/330 |
| 5,690,189 | A * | 11/1997 | Karner | B66B 13/12 | 187/335 |
| 5,819,877 | A * | 10/1998 | Rivera | B66B 13/12 | 187/314 |
| 5,899,302 | A * | 5/1999 | O'Donnell | B66B 13/20 | 187/314 |
| 6,446,759 | B1 * | 9/2002 | Kulak | B66B 13/12 | 187/319 |

(Continued)

*Primary Examiner* — Anthony J Salata

(74) *Attorney, Agent, or Firm* — Lerner, David, Littenberg, Krumholz & Mentlik, LLP

(57) ABSTRACT

The disclosure provides for a locking system for an elevator car door that includes a locking apparatus mounted to the elevator car door. The locking apparatus includes an elevator door latch arm, a sensing vane, and a fixed vane. The elevator door latch arm has one end configured to be inserted into a catch to lock the elevator car door. The sensing and fixed vanes are generally parallel to one another. When the elevator car door is aligned with a hoistway door, an outer surface of the sensing vane is configured to engage with a roller on the hoistway door, and an outer surface of the fixed vane is configured to engage with another roller on the hoistway door. When both the first and second rollers are engaged by the sensing and fixed vanes, the locking apparatus is configured to remove the elevator door latch arm from the catch.

7 Claims, 13 Drawing Sheets

(56) References Cited

U.S. PATENT DOCUMENTS

| | | | | |
|---|---|---|---|---|
| 6,508,332 | B2 * | 1/2003 | Fahl | B66B 13/12 187/316 |
| 7,607,517 | B2 * | 10/2009 | Karner | B66B 13/12 187/310 |
| 2012/0298453 | A1 * | 11/2012 | Fujii | B66B 13/12 187/330 |

* cited by examiner

100

100

300A

300C

300

300

300

300

300

300A

600

METHOD AND SYSTEM FOR ELEVATOR DOOR LOCKING AND DETECTION OF ELEVATOR DOOR LOCKING STATE

BACKGROUND

Automatic elevator car systems, i.e., systems in which the car door automatically opens when the car reaches a landing floor and closes before the car leaves a landing floor, are well-known in the art. Conventional elevator systems also may have either an automatic sliding or a manually operable, swinging hoistway door. In such systems, the hoistway door may be automatically opened and closed or may be manually opened and closed. In such systems, there usually is a switch or switches operable when the hoistway door is closed and a switch or switches operable when the car door or gate is closed which permits the car hoisting system to move the car to another landing floor when all switches have been operated to obtain a predetermined switching state, such as closed. Also, such systems usually include locking assemblies which prevent opening of the doors unless the car is substantially level with the floor at which the doors control entrance and egress from the car, and include an edge detector on one or more of the doors to reopen the doors and prevent starting of a car from a floor when closing of a door is obstructed.

Various locking assemblies are available that operate to unlock and open an elevator car door only when the locking assembly engages with a corresponding engagement assembly on a hoistway door. In such assemblies, the unlocking and opening of the elevator car through the engagement of the locking assembly with the engagement assembly can occur only when the elevator car arrives at or near a landing floor. If the elevator car stops between floors, the locking assembly under normal operation prevents unlocking and opening of the elevator car, as engagement with the corresponding engagement assembly on a hoistway door does not occur.

There are occasions when movement of an elevator car stops for various reasons, e.g., a power or control failure etc. If the car stops close to a landing floor where a passenger may exit from the car, there is no objection to permitting a passenger to force the car doors open manually since the hoistway doors may be opened, or are open, and the passenger may exit safely. However, if the floor of the car is a substantial distance from level with the landing floor, a passenger, while exiting from the car, may fall under the car into the hoistway.

Although a separate door position detection assembly may be used in conjunction with a locking assembly to detect whether the locking assembly is an unlocked or locked state and provide information, via electronic means, indicating the locking state, and thus whether the elevator car is opened or closed, to an elevator control unit, such detection assembly is an additional component adding cost and complexity to components used to operate elevator car doors and hoistway doors of an elevator system. In addition, when the door position detection assembly and the locking assembly operate independently from one another, there is a risk that one may be disabled without also disabling the other, causing a disconnect between the two assemblies.

There is a need for a simple and inexpensive elevator car locking system that is operable to unlock and lock an elevator car door based on the position of an elevator car door in relation to a hoistway door and to supply information indicating whether the locking system is in an unlocked or locked state, thereby indicating whether the elevator car door is open or closed.

BRIEF SUMMARY

The present disclosure may permit the addition to an existing elevator system of a relatively simple locking system which may integrate an electronic lock detector with an interlock in a locking apparatus of the locking system. The locking system may cause the interlock to transition from the locked state to the unlocked state so that the closed elevator car door of the elevator system is opened, only when the locking apparatus is in an engaged state with an engagement apparatus of the locking system mounted to a hoistway door. The locking apparatus may ensure normal operation of an elevator car regardless of malfunction or tampering, such as, by preventing of opening the elevator car doors when they are not aligned with hoistway doors. The electronic lock detector of the locking system may supply, to an elevator control unit, detected information indicating whether the locking system is in an unlocked or locked state, thereby indicating to the control unit whether the elevator car door is in an open or closed state. In addition, the principles of the present disclosure are also applicable to newly installed elevator systems.

DETAILED DESCRIPTION

Overview

An elevator system may have a door system that includes one or more elevator car doors for each elevator car and one or more hoistway doors for each floor. The elevator system may be configured to include a locking apparatus that engages with an engagement apparatus coupled to the one or more hoistway doors when the one or more elevator car doors are aligned with the one or more hoistway doors. An interlock configured to unlock when the locking apparatus including the interlock is engaged with the one or more hoistway doors via the engagement apparatus, thereby permitting opening of the one or more closed elevator car doors, may be included in the elevator system. The elevator system may further be configured to detect that both an elevator car door of a given elevator car at a given floor and a hoistway door of the given floor are aligned, before the elevator car door is permitted to be opened. The elevator system may further include an electronic interlock controller, or any type of detection device, that may detect whether the interlock is in a locked or unlocked state, and provide information indicating the state of the interlock to an elevator control unit of the elevator system. In this way, the resulting elevator system may be safer and more secure than some of the existing elevator systems.

Example Systems

Figure 1:
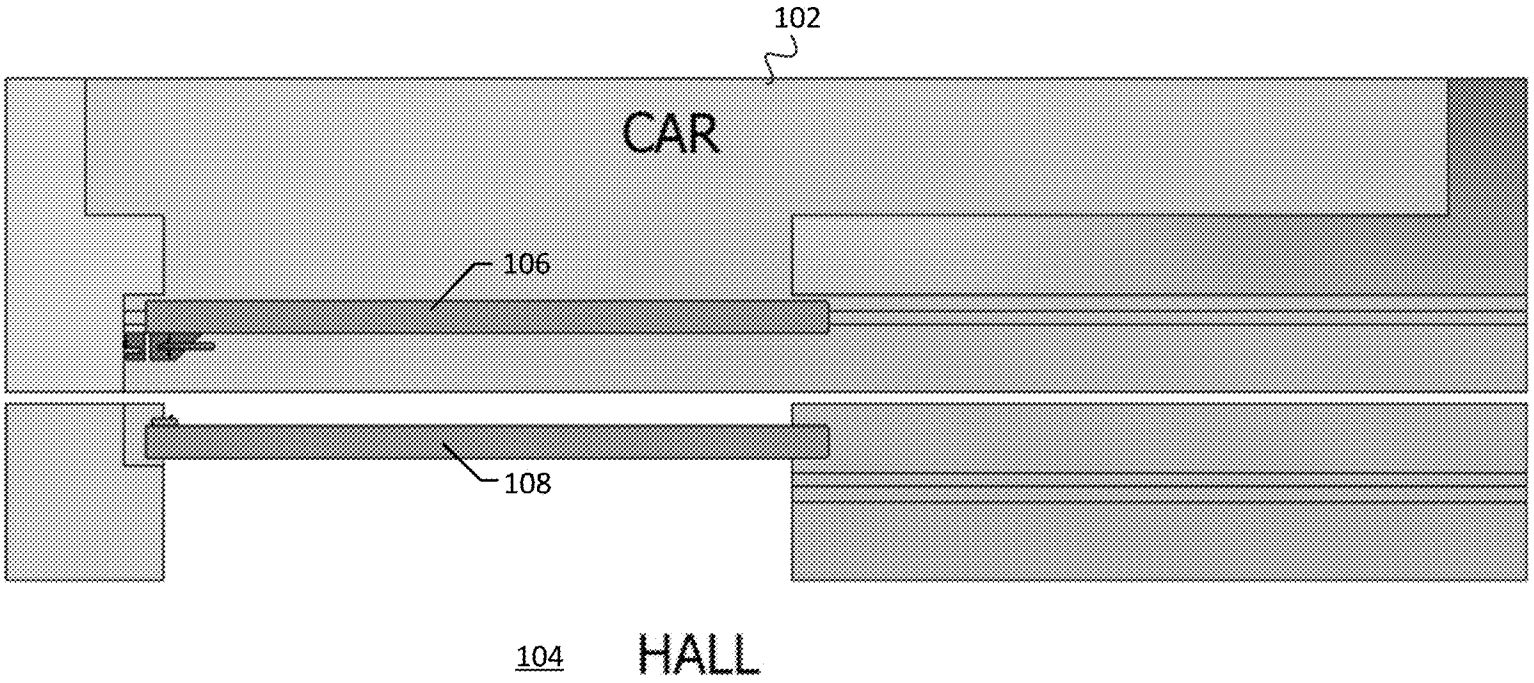
FIG. 1 is a top-down view of an elevator system 100 in accordance with aspects of the disclosure.

As shown in FIG. 1, an elevator system 100 may include a given elevator car 102. The given elevator car 102 may have an elevator car door 106, which may be a sliding door. The given elevator car 102 may be configured to align with an opening of an elevator shaft at a floor of a building, across from a hall 104. When positioned aligned with the opening at the floor of the building, an elevator car doorway may be aligned with a hoistway doorway, and a closed elevator car door 106 may also be aligned with and parallel to a closed hoistway door 108. Hoistway door 108 may be a sliding door.

Figure 2:
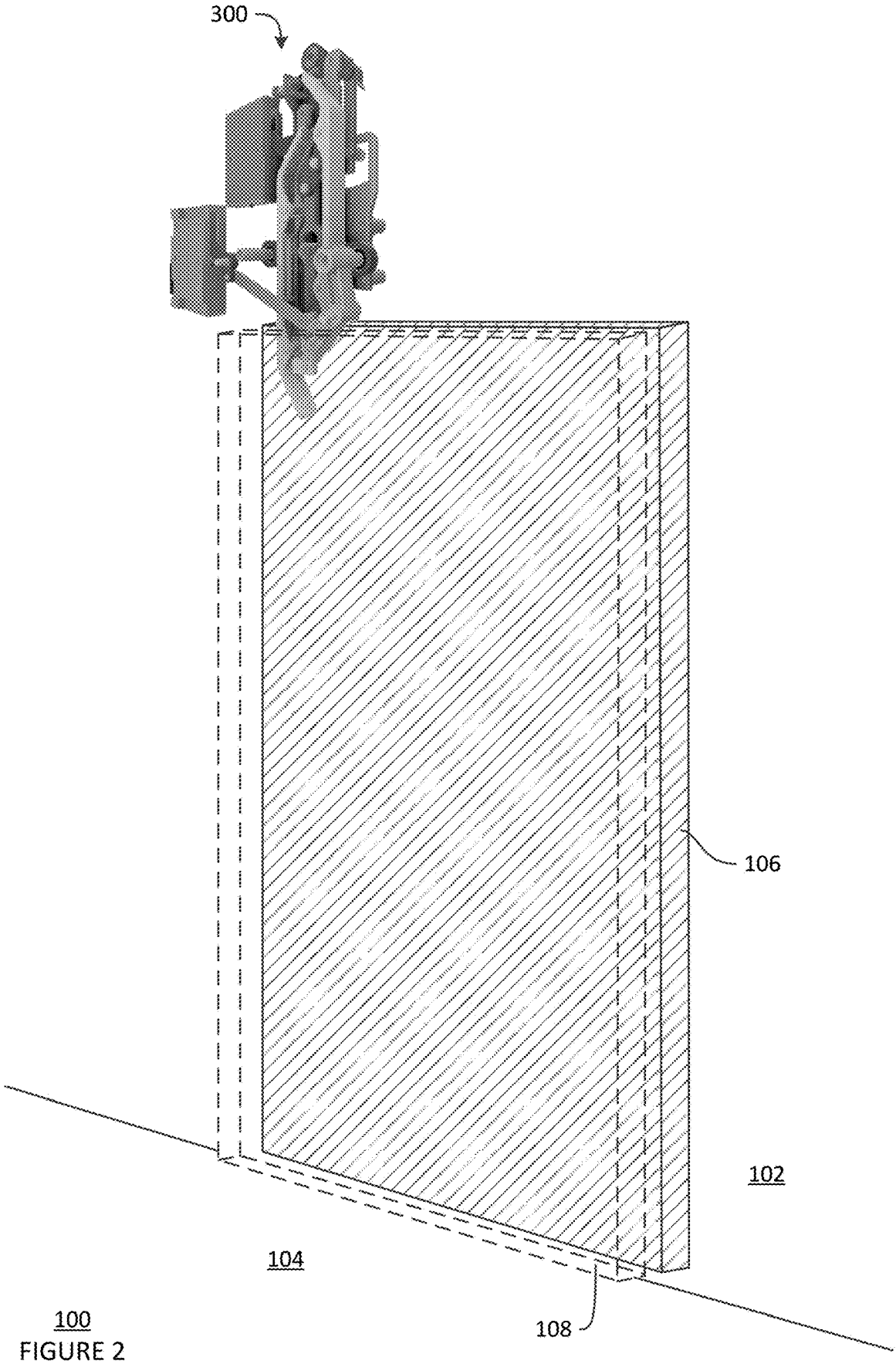
FIG. 2 is a perspective view of the elevator system 100 in accordance with aspects of the disclosure.

FIG. 2 depicts an elevator system 100 where the elevator car door 106 is aligned with the hoistway door 108, and both the elevator car door 106 and the hoistway door 108 are closed and locked. As shown, the elevator system 100 may include a locking system 300 that is mounted to the elevator car door 106 and the hoistway door 108. The locking system 300 may be mounted in a manner that such that the locking system 300 is completely or mostly above the elevator car 102 when the elevator car door 106 is aligned with the hoistway car door 108, as shown in FIG. 2.

Figure 3A:
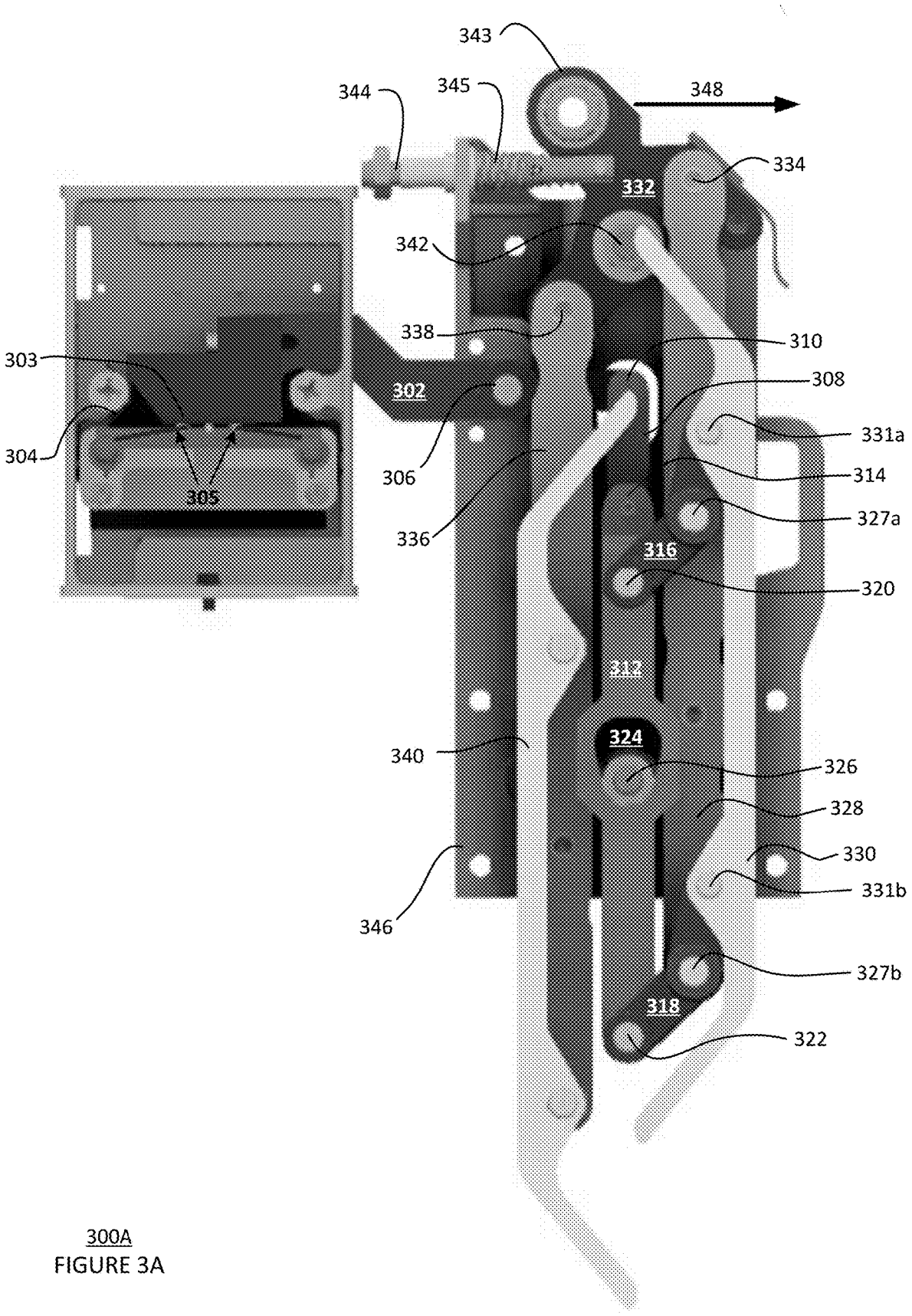
FIG. 3A is a front view of a locking apparatus 300A of a locking system in accordance with aspects of the disclosure.
Figure 3B:
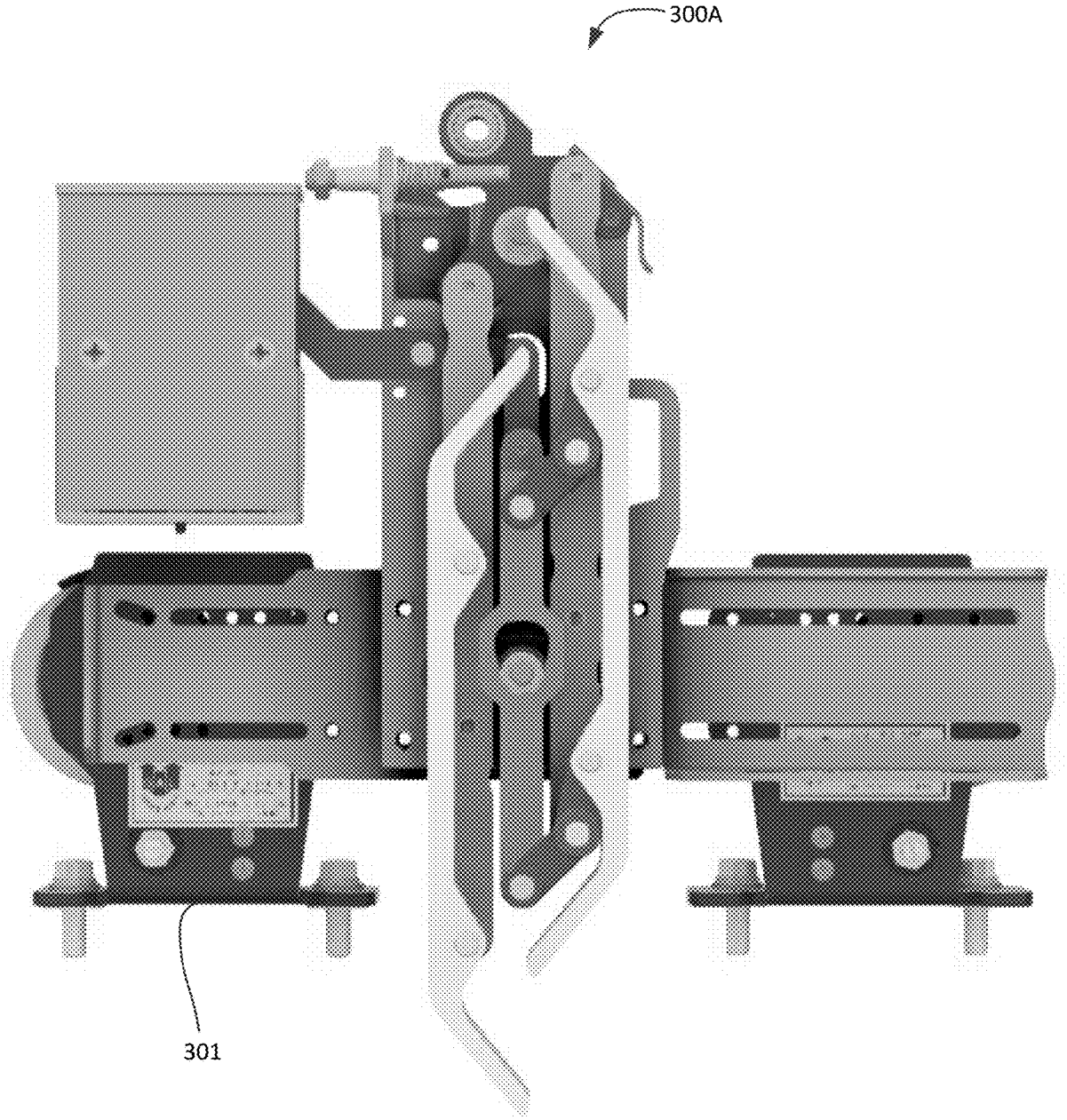
FIG. 3B is a front view of the locking apparatus 300A mounted on a portion of an elevator subsystem in accordance with aspects of the disclosure.
Figure 3C:
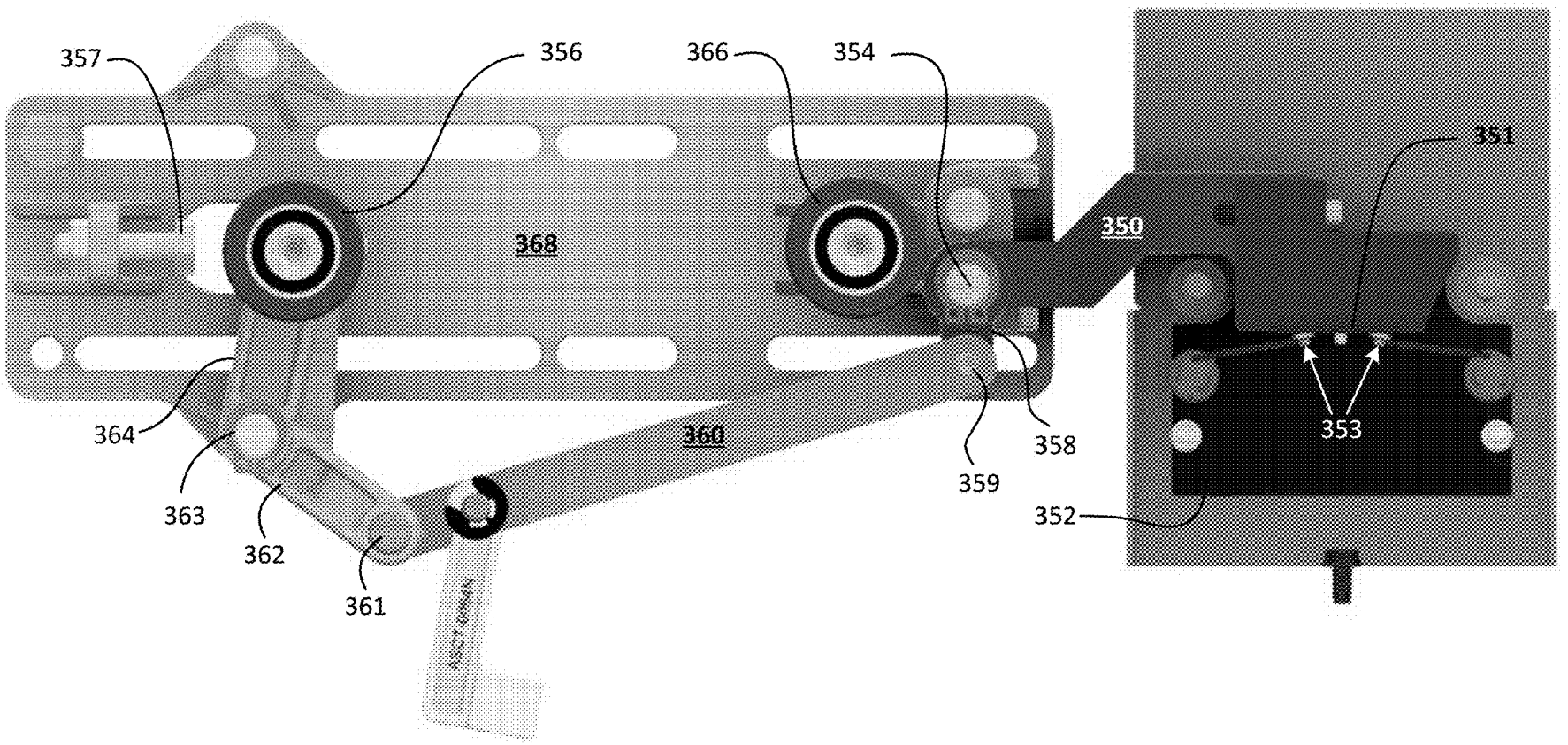
FIG. 3C is a front view of an engagement apparatus 300C of the locking system in accordance with aspects of the disclosure.

FIGS. 3A-3C depict the two different components of system 300, locking apparatus 300A and engagement apparatus 300C. The locking apparatus 300A is mounted to the elevator car door 106, and the engagement apparatus 300C is mounted to the hoistway door 108. Both the locking apparatus 300A and the engagement apparatus 300C may include an interlock that is configured to move so as to transition between an interlock locked position, where a latch arm is fitted within a catch, and an interlock unlocked position, where the latch arm is removed from the catch. The locking apparatus 300A is in a locking apparatus locked position when the interlock of the locking apparatus 300A is in the interlock locked position and the various vanes and arms of the locking apparatus 300A are folded as shown in FIG. 3A. Likewise, the engagement apparatus 300C is in an engagement apparatus locked position when the interlock of the locking apparatus 300C is in the interlock locked position and the various rollers and arms are positioned as shown in FIG. 3C. This will be discussed in more detail below.

In FIG. 3A, the locking apparatus is shown from the perspective of a view facing the outer surface of the elevator car door 106 from outside the elevator car 102. The interlock of the locking apparatus 300A may comprise an elevator door latch arm 302, a shorting bar 303, a catch 304, and at least two contacts 305. The elevator door latch arm 302, or a keeper, may be configured to hook onto the catch 304, thereby obtaining a locked position of the interlock, so as to keep the elevator car door 106 in a closed position. The closed elevator car door 106 is not able to slide open when the elevator door latch arm 302 is hooked onto the catch 304. The catch 304 may be positioned in a box, as shown in FIG. 3A. For visibility purposes, the outer wall of the box has been removed. The elevator door latch arm 302 may include a shorting bar 303 at a distal end of the elevator door latch arm 302. The shorting bar 303 may be configured to contact at least two contacts 305 positioned on or near the catch 304 when the interlock of the locking apparatus 300A is in the interlock locked position. The elevator door latch arm 302 may have a fulcrum 306 in the middle of the elevator door latch arm 302 and be connected to a first vertical arm 308 via a first pivot point 310. The first pivot point 310 may be positioned at a proximate end of the elevator door latch arm 302 and an upper end of the first vertical arm 308. In the locking apparatus locked position, the elevator door latch arm 302 and the first vertical arm may form about a 90 degree angle.

The first vertical arm 308 may be connected to a second vertical arm 312 via a second pivot point 314. The second pivot point 314 is positioned at a lower end of the first vertical arm 308 and an upper end of the second vertical arm 312. In the locking apparatus locked position, the first vertical arm 308 is collinear with the second vertical arm 312. More distal from the upper end of the second vertical arm 312 than the second pivot point 314, the second vertical arm 312 is connected to two rocking arms 316, 318 via pins 320, 322, respectively. Pin 320 is positioned in a middle portion of the second vertical arm 312, and pin 322 is positioned at a lower end of the second vertical arm 312. Between the pins 320, 322 may be an opening 324 positioned around a center pin 326 which limits the movement of the second vertical arm 312 to a range of motion corresponding to the area of the opening 324. Alternatively, other designs for limiting the movement of the second vertical arm 312 may be implemented.

Each rocking arm comprises two members, which are joined at a middle point with a corresponding pin 327*a* or 327*b*. A first member of a given rocking arm and a second member of the given rocking arm may form an obtuse angle. The pins 327*a*, 327*b* attach both members of the rocking arms 316, 318 to a third vertical arm 328. The first member of the given rocking arm attaches to the second vertical arm 312 via corresponding pin 320 or 322, and the second member of the given rocking arm attaches to a sensing vane 330 via corresponding pin 331*a* or 331*b*. Sensing vane 330 is generally vertical, and may have angled ends that curve slightly in a direction towards the rocking arms 316, 318.

An upper pivot 332 is attached to the third vertical arm 328 at a third pivot point 334. The third pivot point 334 is positioned at an upper end of the third vertical arm 328 and at a first attachment point of the upper pivot 332. The upper pivot 332 is also attached to a fourth vertical arm 336 via a fourth pivot point 338. The fourth pivot point 338 is positioned at a second attachment point of the upper pivot 332, which is a distance from the first attachment point, and is positioned at an upper end of the fourth vertical arm 336. The fourth vertical arm 336 may be approximately the same length as the third vertical arm 328, and may be positioned parallel to the third vertical arm 328. A fixed vane 340 is mounted on the fourth vertical arm 336, such that the fixed vane 340 is fixed relative to the fourth vertical arm 336. The fixed vane 340 may be approximately the same length as the sensing vane 330. The upper pivot 332 is configured to rotate about the pin 342, which is positioned between the third pivot point 334 and the fourth pivot point 338.

The upper pivot 332 also has an upper arm 343 that extends upwards from the pin 342 in relation to center pin 326. The upper arm 343 is contacted by a pin 344 that is configured to apply a force that results in a torque about the pin 342. In other words, the pin 344 may contact the upper arm 343 at a distance away from the pin 342 and apply the force in a direction substantially perpendicular to the pin 342. The pin 344 may include a torsion spring or other component that is configured to apply the force. Furthermore, the pin 344 may be configured to fit within an opening a base plate 346 where a proximal end of the pin 344, which contacts the upper arm 343, may be on one side of the opening and a distal end of the pin 344 may be on the other side of the opening. The torsion spring may be located along the distal end between the base plate 346 and the upper arm 343. At the distal end of the pin 344 may be a bolt or other type of stopper that is larger than the opening in the base plate 346 in order to stop the pin 344 from moving completely through the opening.

The upper pivot 332 is configured to move when the force from the pin 344 is combined with an external force, illustrated in FIG. 3A as arrow 348. The external force 348 may be in a same or similar direction as the force from the pin 344. Additionally, the external force 348 may be provided at the upper arm 343 by a motor or other form of drive not shown. In some examples, the upper arm 343 may be attached to a belt, such as via a roller bearing on the upper arm. The belt may be moved horizontally by a motor to apply the external force 348. Under the combination of the force from the pin 344 and the external force 348, the upper pivot 332 rotates clockwise about pin 342, thereby initially causing the third vertical arm 328 and the sensing vane 330 to rotate clockwise downward with respect to a pin 342 and away from the second vertical arm 312. At the same time, both members of rocking arm 316 may rotate about pins 320 and 327*a*, respectively. The rotation of the upper pivot 332 also causes the fourth vertical arm 336 and fixed vane 340 to rotate clockwise upward with respect to the pin 342 and away from the second vertical arm 312. At the same time, both members of rocking arm 318 may simultaneously rotate about pins 322 and 327*b*, respectively.

The locking apparatus 300A is attached to a base plate 346, which is mounted to the elevator car door 106. In particular, the locking apparatus 300A may be attached to the base plate 344 via the fulcrum 306, the center pin 326, and the pin 342. The locking apparatus 300A may be attached to the base plate 346 such that the locking apparatus 300A is completely or mostly above the elevator car 102, as previously shown in FIG. 2. For example, as shown in FIG. 3B, the locking apparatus 300A may be mounted to an elevator roller system 301 as shown. The elevator roller system is mounted to the top of an elevator car door, so the majority of the locking system 300A may be above the elevator car door.

As shown in FIG. 3A, in the locking apparatus locked position, the fourth vertical arm 336 is closer to the distal end of the elevator door latch arm 302 than the first and second vertical arms 308 and 312, and the first and second vertical arms 308 and 312 are closer to the distal end of the elevator door latch arm 302 than the third vertical arm 328. In addition, the fourth vertical arm 336 and the fixed vane 340 are substantially parallel to and positioned farther from the pin 342 than the third vertical arm 328 and the sensing vane 330. When the upper pivot 332 pivots about pin 342, the third vertical arm 328 rotates clockwise downward with respect to the pin 342 and away from the second vertical arm 312 while remaining substantially vertical, and the fourth vertical arm 336 rotates upward in the direction of the pin 342 and away from the second vertical arm 312 (see FIGS. 4B and 4C) while remaining substantially vertical and substantially parallel to the third vertical arm 328. In the locking apparatus unlocked position (see FIG. 4D), the fourth vertical arm 336 and the fixed vane 340 are substantially parallel to and are at about the same height as the third vertical arm 328 and the sensing vane 330.

In FIG. 3C, the engagement apparatus is shown from the perspective of a view facing the hoistway door 108 from inside an elevator shaft. The interlock of the engagement apparatus 300C comprises a hoistway door latch arm 350 and a catch 352, and in some examples may also include a shorting bar 351 and at least two contacts 353. The hoistway door latch arm 350 is configured to hook onto the catch 352, thereby obtaining a locked position of the interlock, so as to keep the hoistway door 108 in a closed position. The hoistway door 108 is not able to slide open when the hoistway door latch arm 350 is hooked onto the catch 352. The catch 352 may be positioned in a box, as shown in FIG. 3C. For visibility purposes, the outer wall of the box and one or more walls of interior boxes have been removed. In some implementations, the hoistway door latch arm 350 may include a shorting bar 351 at a distal end of the hoistway door latch arm 350, similar to the shorting bar 303 of the elevator door latch arm 302. The shorting bar 351 may be configured to contact at least two contacts 353 positioned on or near the catch 352 when the interlock of the engagement apparatus 300C is in the engagement apparatus locked position.

The hoistway door latch arm 350 has a fulcrum 354 at the proximate end of the hoistway door latch arm and is connected to a first roller 356 via a series of arms. The series of arms may include arms 358, 360, 362, 364 connected end to end via attachment points 359, 361, and 363. The arm 358 is integral with the hoistway door latch arm 350, forming a fixed angle with the hoistway door latch arm, such as about 90 degrees. Alternatively, the arm 350 may be a separate member attached to the fulcrum 354 at the fixed angle. The arm 360 links arm 358 and 362 via attachment points 359 and 361, forming an angle less than 180 degrees with arm 362. Arm 362 and arm 364 are a unitary component forming an angle less than 180 degrees. For example, the unitary component may be a solid aluminum casting. The attachment point 363 is in fact a fixed pivot point of the unitary component that is fixed on a base plate 368. Alternatively, arm 362 and arm 364 may be separate components that are joined at attachment point 363 at a fixed angle and that are configured to rotate about attachment point 363 as a unitary component. At the end of arm 364 opposite arm 362, the first roller 356 is attached.

The first roller 356 is configured to move relative to the fulcrum 354, between a proximal position and a distal position. The proximal position is located between the fulcrum 354 and a stopper 357 that is mounted on the base plate 368 along the same or similar axis as the first roller 356 and a second roller 366. The distal position is farther away from the fulcrum 354 than the proximal position, and is located where the first roller 356 comes into contact with the stopper 357. The stopper 357 may be adjustable, and may be used to adjust the location of the distal position. For example, the stopper 357 may comprise a threaded bolt with a nut that may be moved along the threaded portion of the bolt to adjust the position of the stopper. A biasing force causes the first roller 356 to be biased in the proximal position. The biasing force may be provided by gravity, a weight attached to one or more of the series of arms, a spring in one or more of the attachment points, and/or other type of external force. When in the engagement apparatus locked position, the first roller 356 may be at rest at the proximal position, as shown in FIG. 3C. When the first roller 356 moves away from the fulcrum 354, the hoistway door latch arm 350 is removed from the catch 352. For example, the series of arms may cause the hoistway door latch arm 350 to rotate counterclockwise about the fulcrum 354 and out of the catch 352, thereby obtaining an unlocked position of the interlock, as described in detail below. Between the hoistway door latch arm 350 and the first roller 356 is the second roller 366. The second roller 366 is fixed in relation to the fulcrum 354.

The engagement apparatus 300C is attached to a base plate 368, which is mounted to the hoistway door 108. Namely, the fulcrum 354, the first roller 356, the stopper 357, the attachment point 363, and the second roller 366 are attached to the base plate 368. The engagement apparatus 300C may be attached to the base plate 368 such that the engagement apparatus 300C is completely or mostly above the hoistway door 108, as previously shown in FIG. 2

FIGS. 4A-4E depict the locking system 300 at different stages of operation when the elevator car door 106 is aligned with the hoistway door 108. Both the locking apparatus 300A and the engagement apparatus 300C are shown from the perspective of a view of facing the outer surface of the elevator car door 106 from outside the elevator car 102. Again, the outer wall of the box and one or more walls of interior boxes have been removed for visibility purposes. Furthermore, because the base plate 368 would obscure the rollers 356, 366 and some of the series of arms, the base plate 368 is depicted as semi-transparent for visibility purposes.

Figure 4A:
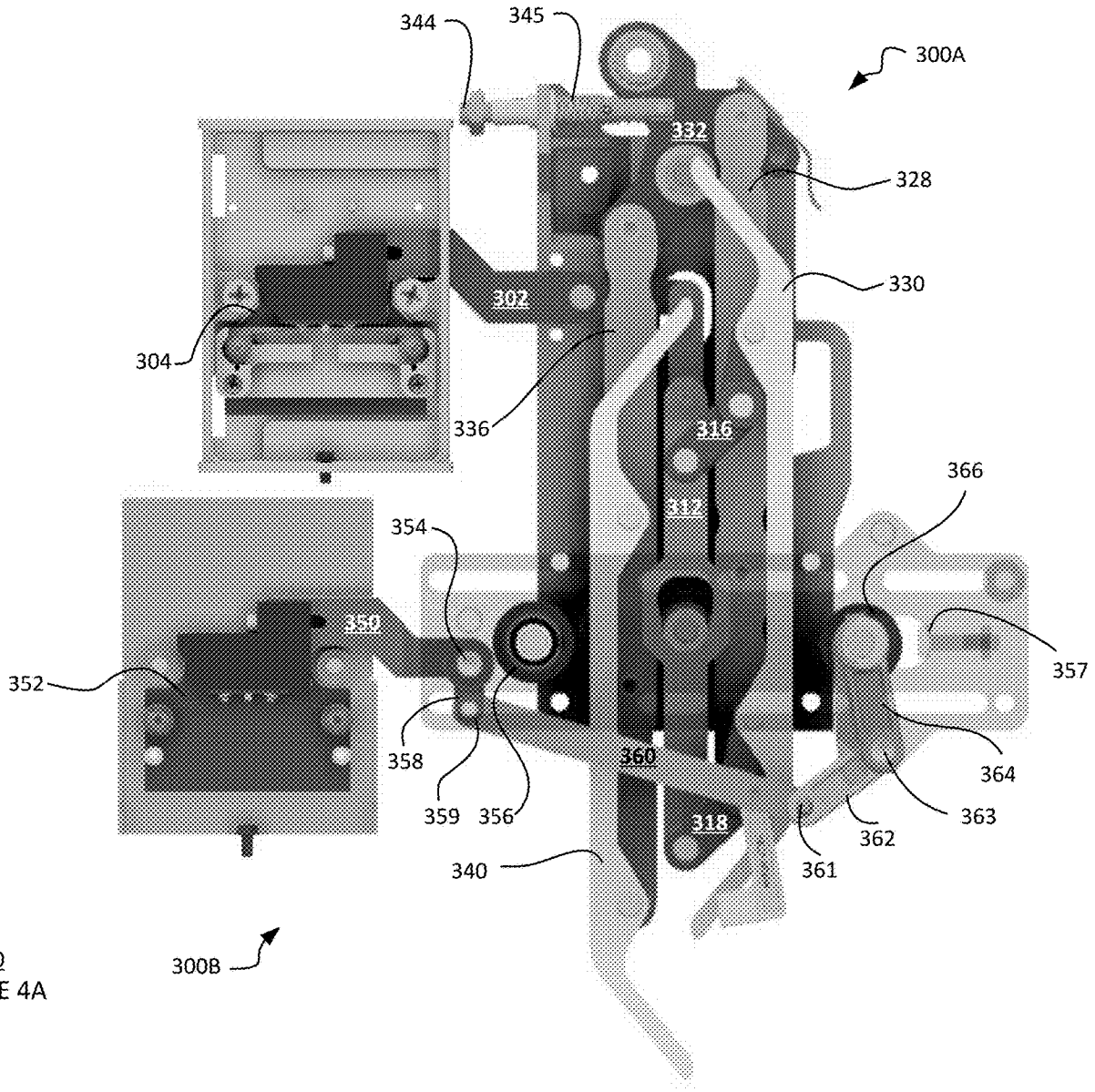
FIGS. 4A-4E are front views of the locking system 300 of the elevator system 100 at different stages of operation in accordance with aspects of the disclosure.

FIG. 4A depicts a locking system locked position of the locking system 300 during which the sensing vane 330 and the fixed vane 340 are positioned between the first and second rollers 356, 366. In the locking system locked position, the locking apparatus 300A is in the locking apparatus locked position, and the engagement apparatus 300C is in the engagement apparatus locked position. In the locking system locked position, the elevator door latch arm 302 and the hoistway door latch arm 350 are both hooked into their respective catches 304, 352. The shorting bar 303 on the elevator door latch arm 302 is making electrical contact with corresponding contacts 305 in the catch 304. In this example, a shorting bar 351 on the elevator door latch arm 359 may also make electrical contact with corresponding contacts 353 in the catch 352.

Figure 4B:
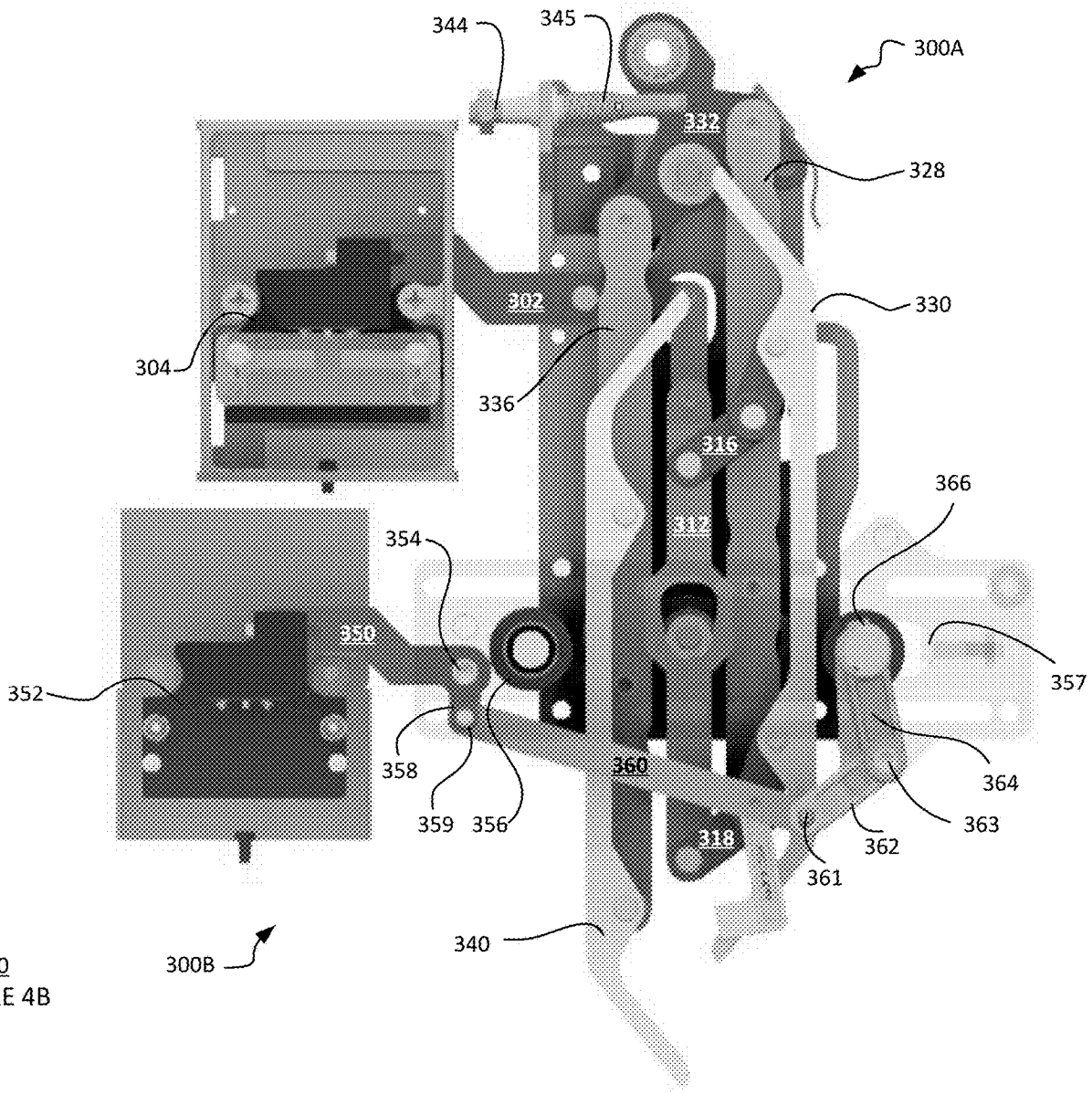

FIG. 4B depicts an intermediate position of the system during which the torsion spring on pin 344 is activated by the external force 348 to begin rotating the upper pivot 332 clockwise about pin 342. As a result, at least the third vertical arm 328 and the sensing vane 330 move downward with respect to the pin 342 and away from pins 320, 322 and closer to first roller 356. The rocking arms 316, 318 rotate clockwise about the pins 320, 322 as pins 327*a*, 327*b* are moved along with the third vertical arm 328. The sensing vane 330 may also begin to rotate clockwise about pins 327*a*, 327*b* by nature of the shape and motion of the rocking arms 316, 318. Also as a result of the rotation of the upper pivot 332, the fourth vertical arm 336 and the fixed vane 340 move upward in the direction of the pin 342 and away from pins 320, 322 and closer to second roller 366. The distance between the sensing vane 330 and the fixed vane 340 is widened as both vanes move in the manner described. The distance between the third vertical arm 328 and the fourth vertical arm 336 is also widened as they also move as described. The first vertical arm 308 and the second vertical arm 312 may remain generally collinear at this step. The elevator door latch arm 302 may remain in the catch 304, with the shorting bar 303 in contact with the contacts 305.

Figure 4C:
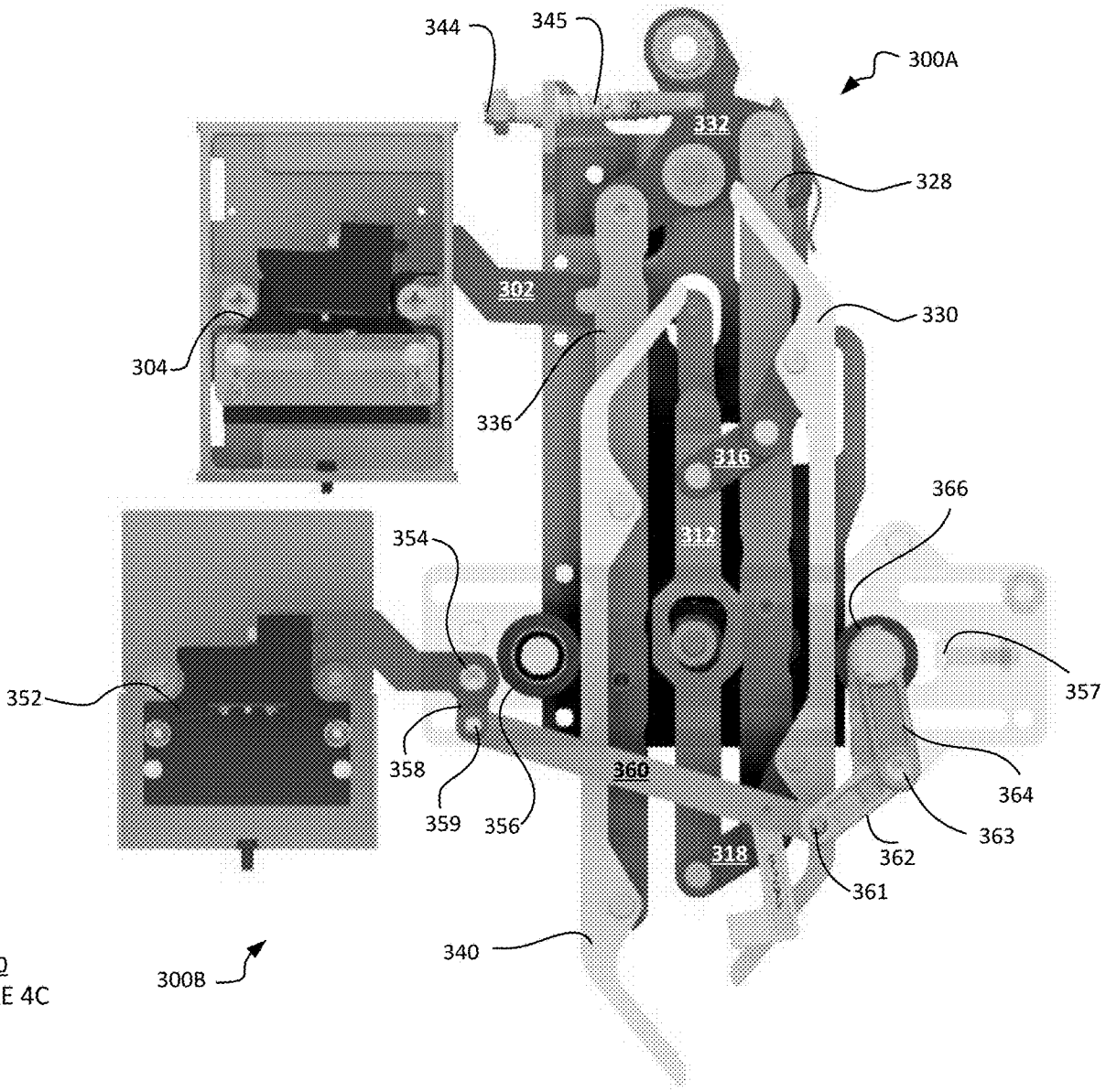

FIG. 4C depicts a contact position of the locking system 300 during which the sensing vane 330 and the fixed vane 340 contact roller 356 and roller 366, respectively. From the intermediate position, the upper pivot 332 continues to rotate and cause rocking vane 330 and fixed vane 340 to move in the direction of the contact rollers 356, 366, respectively. The third vertical arm 328 and the sensing vane 330 continue to move downward with respect to the pin 342 and away from pins 320, 322 and closer to first roller 356. The sensing vane 330 also continues to rotate clockwise about pins 327*a*, 327*b* by nature of the shape and motion of the rocking arms 316, 318. In addition, the fourth vertical arm 336 and the fixed vane 340 continue to move upward in the direction of the pin 342 and away from pins 320, 322 and closer to second roller 366. Once in the contact position, the distance between the sensing vane 330 and the fixed vane 340 is wider than in the intermediate position, and the distance between the third vertical arm 328 and the fourth vertical arm 336 is also wider than in the intermediate position. When initial contact is made, the first roller 356 may contact the sensing vane 330 at a first contact location, and the second roller 366 may contact the fixed vane 340 at a second contact location. The biasing force on the first roller 356 may provide a resistance force on the sensing vane 330 in a direction towards the fixed vane 340. At this stage, the first vertical arm 308 and the second vertical arm 312 may remain generally collinear.

From the contact stage, the sensing vane 330 remains fixed with respect to the first roller 356 and is limited in movement by the resistance force and the range of motion of first roller 356. Meanwhile, the third vertical arm 358 continues to move unimpeded downward with respect to the pin 342 and away from the second vertical arm 312. The sensing vane 330 (as well as the second member of each rocking arm) may begin to move closer to the third vertical arm 358, similar to a motion of closing scissor blades. As a result, rocking arms 316, 318 may begin to rotate counterclockwise about the pins 327*a*, 327*b*, respectively, which may push the second vertical arm 312 downward with respect to the pin 342. The elevator door latch arm 302 may therefore begin to lift out of the catch 304 at this stage, with the shorting bar 303 removed from the contacts 305.

Figure 4D:
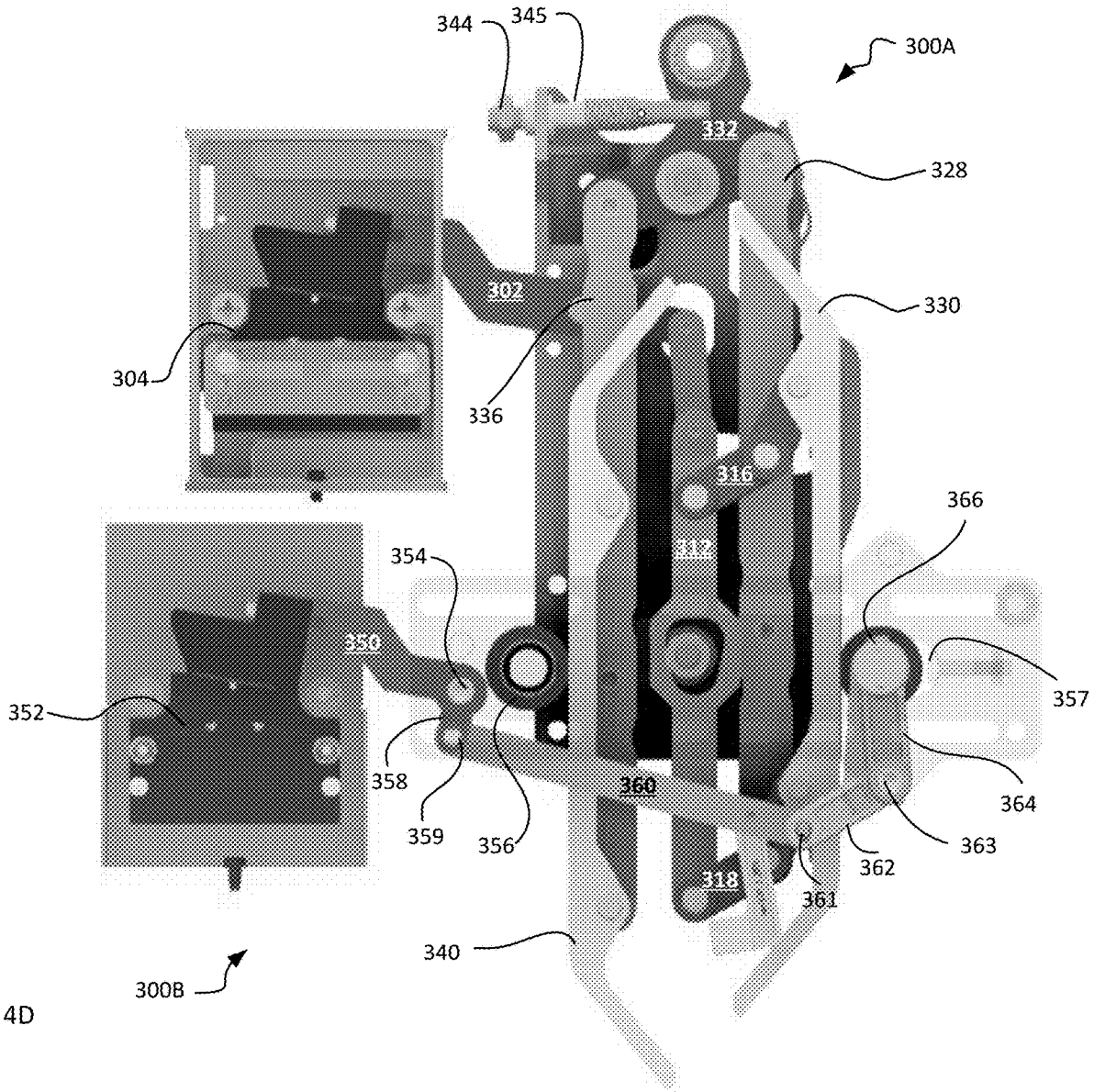

FIG. 4D depicts an engagement position of the locking system 300 during which the third vertical arm 358 continues to move away from and downward with respect to the pin 342, and the sensing vane 330 continues to move upward and closer to the third vertical arm 358. The distance between the sensing vane 330 and the fixed vane 340 is wider than in the contact position, and the distance between the third vertical arm 328 and the fourth vertical arm 336 is also wider than in the contact position. At this stage, the sensing arm 330 remains in contact with the first roller 356 at the first contact point and may also move towards the stopper 357 along with the first roller 356 as pins 327*a*, 327*b* are driven towards the first roller 356 by the movement of the third vertical arm. As a result of the sensing arm 330 moving closer to the third vertical arm, the second vertical arm 312 continues to move downward with respect to the pin 342. The second vertical arm 312 may also move horizontally towards the first roller 358. The horizontal movement may be slight compared to the downward movement. While the second vertical arm 312 remains generally vertical while moving, the first vertical arm 308 rotates counterclockwise because the first vertical arm 308 is attached to the elevator door latch arm 302, which has a fixed fulcrum 306. The first vertical arm 308 therefore becomes angled with respect to the second vertical arm 312 at the second pivot point 314. As the first vertical arm 308 rotates counterclockwise, the proximate end of the elevator door latch arm 302 is pushed away from the upper pivot 332 and downward with respect to the pin 342, which causes the elevator door latch arm 302 to rotate clockwise about the fulcrum 306. The distal end of the elevator door latch arm therefore moves even further out of the catch 304.

As the sensing vane 340 pushes the first roller 356 towards the stopper 357, the series of arms causes the hoistway door latch arm 350 to pivot clockwise about its fulcrum 354. For example, the first roller 356 may be pushed towards the stopper 357 by the sensing vane 330, which may rotate both arms 362, 364 about attachment arm 363 in a counterclockwise direction. The counterclockwise rotation of arm 362 may cause the angle between arms 362 and 360 to straighten, which may push arm 360 in the direction of the catch 352. The attachment point 359 may be moved towards the catch 352 as a result, and may cause arm 358 and hoistway door latch arm 350 to rotate about fulcrum 354 in a counterclockwise direction lifting the distal end of the hoistway door latch arm 350 out of the catch 352, thereby obtaining the interlock unlocked position. If the hoistway door latch arm 350 has a shorting arm 351 that is in contact with two or more contacts 353, the shorting arm 351 would be removed from the contacts 353 at this stage.

The fixed vane 340 in the engagement position continues to move upward in the direction of the pin 342 and away from pins 320, 322. As a result, the second roller 366 rolls along the fixed vane 340 to a third location on the fixed vane that is farther from an end of the fixed vane which is proximal the pin 342 than the second location on the fixed vane.

Figure 4E:
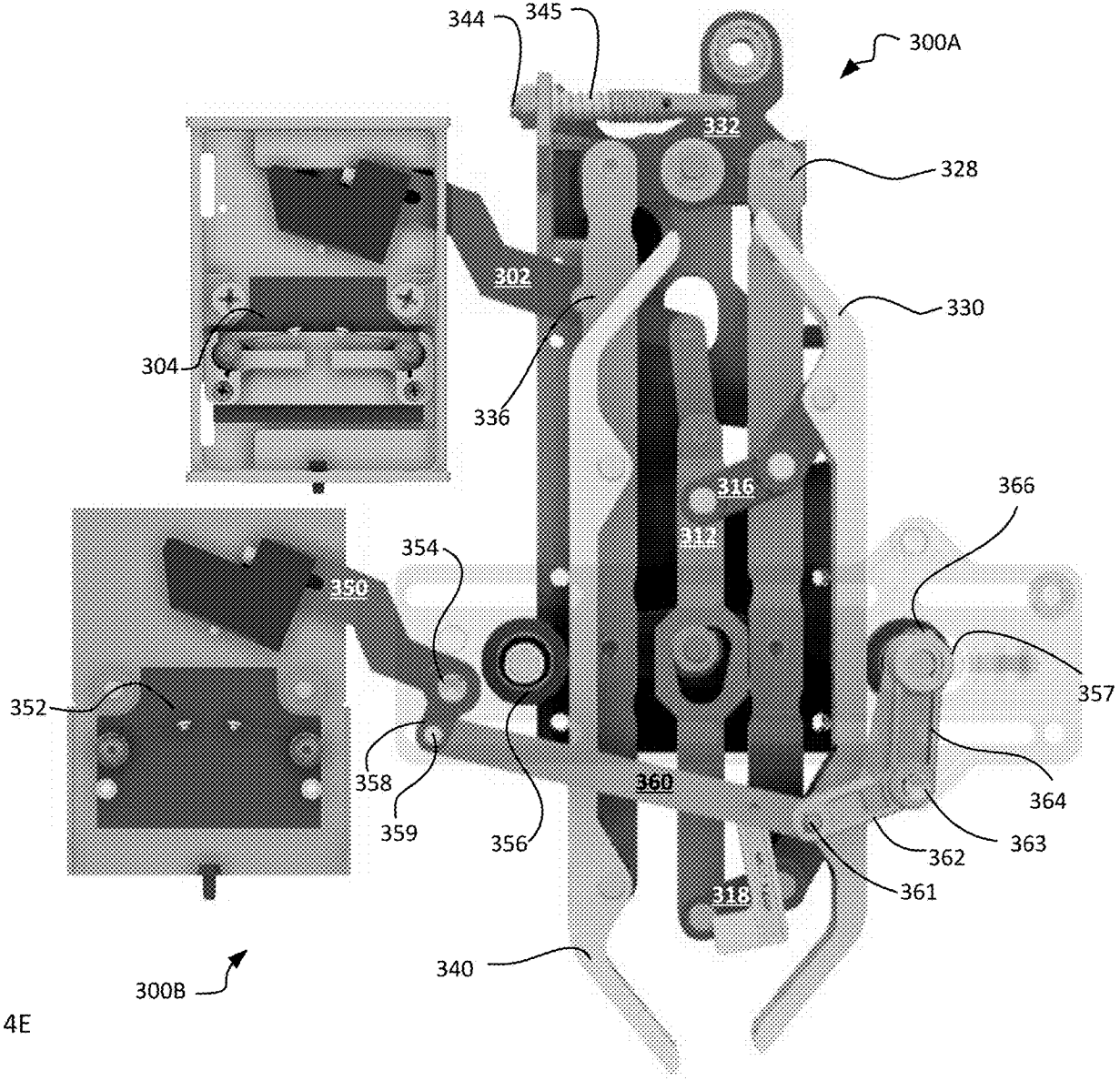

FIG. 4E depicts a locking system unlocked position of the locking system 300 during which the elevator door latch arm 302 and the hoistway door latch arm 350 are completely removed from their respective catches 304, 352 such that the elevator car door 106 and the hoistway door 108 may be opened. In the locking system unlocked position, the locking apparatus 300A is in a locking apparatus unlocked position, and the engagement apparatus 300C is in a locking apparatus unlocked position. In the locking system unlocked position, the sensing vane 330 and the fixed vane 340 are both still in contact with the rollers 356, 366, respectively, are substantially parallel to one another, and are at a more similar height than in the engagement position. The distance between the sensing vane 330 and the fixed vane 340 is wider than in the engagement position, and the distance between the third vertical arm 328 and the fourth vertical arm 336 is also wider than in the engagement position. In the engagement apparatus unlocked position, the first roller 356 is at a location more distal from the hoistway door latch arm 350 than in the engagement position. In some implementations, the first roller 356 is in contact with the stopper 357 in the engagement apparatus unlocked position. In the overall locking system unlocked position, the first roller 356 remains in contact with the sensing vane 330 at the first contact location. The second rollers 366 contacts the fixed vane 340 at or nearly at a midpoint of the fixed vane 340. The midpoint of the fixed vane 340 is farther from the pin 342 than the fourth location on the fixed vane 340. In the locking system unlocked position, both the elevator car door 106 and the hoistway door 108 may slide open away from catches 304, 352, as the latch arms 302, 350 are in a position to clear the respective catches.

Figure 4F:
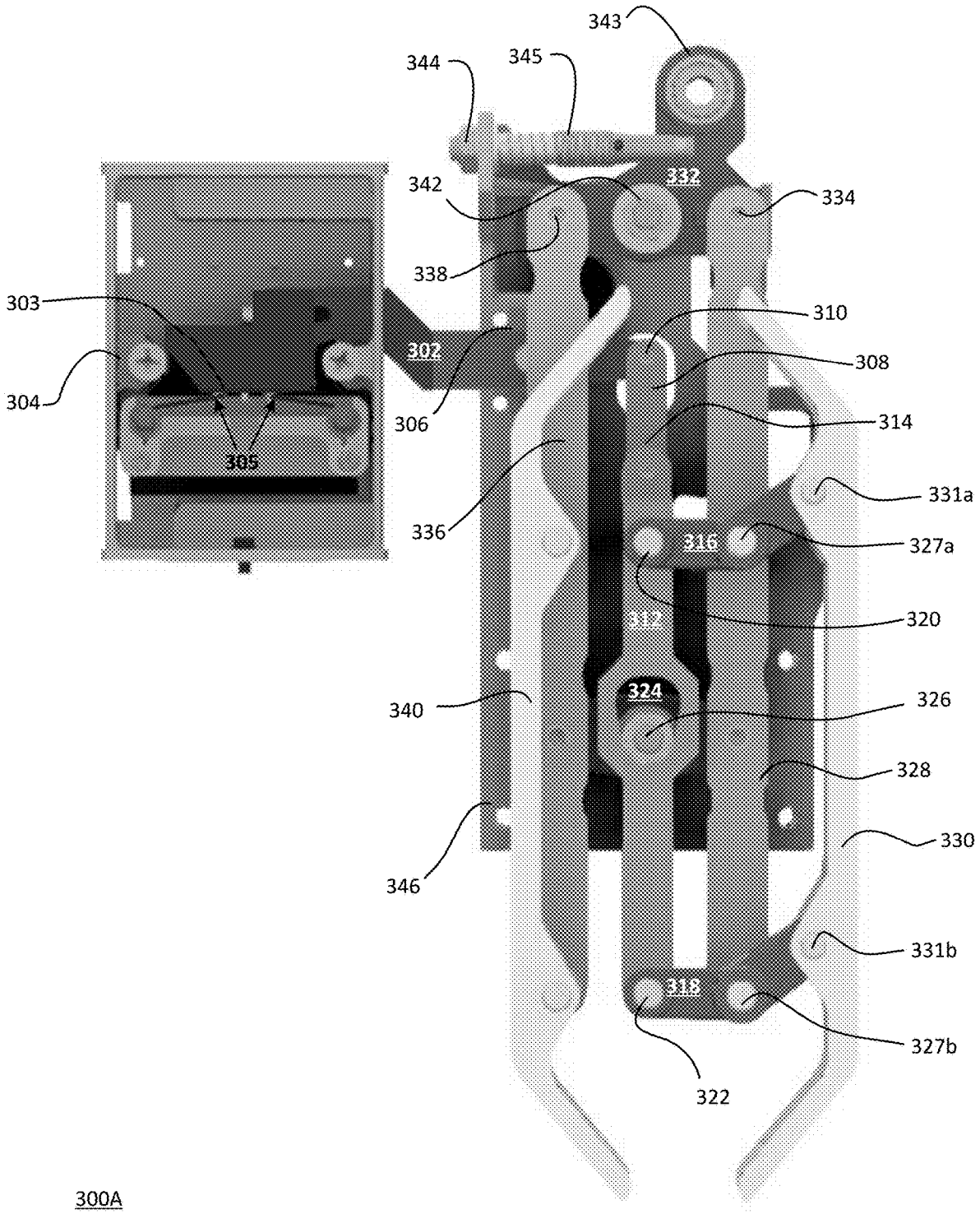
FIG. 4F is a front view of the locking apparatus 300A at a further stage of operation in accordance with aspects of the disclosure.

In situations where the locking apparatus 300A is not properly aligned with the engagement apparatus 300C, the elevator door latch 302 does not rotate to obtain the interlock unlocked position. For example, this situation may occur when the elevator car door 106 is not aligned with a hoistway door 108, in which case the elevator car door should not be unlocked and opened for safety and security purposes. The locking apparatus 300A in these situations will still transition from the locking system locked position to the intermediate position, as described above with respect to FIGS. 4A and 4B, but will not transition to the contact, engagement, or locking system unlocked positions. Instead, from the intermediate position, the pin 320 continues to rotate rocking arm 316 without encountering any resistance force. Because no resistance force is encountered, the motion of the sensing vane 330 continues unimpeded. The sensing vane 330 therefore continues to move downward with respect to the pin 342 and away from the second vertical arm 312. The first vertical arm 308 and the second vertical arm 312 remain collinear. The third vertical arm 328, fourth vertical arm 336, and fixed vane 340 behave the same as before, with the third vertical arm 328 rotating with respect to the pin 342 and away from the second vertical arm 312, and the fourth vertical arm 336 and the fixed vane 340 rotating upward in the direction of the pin 342 and away from the second vertical arm 312. The second vertical arm 312 is held in place by pin 326, which prevents any upward movement that would otherwise occur in response to the rotations of the rocking vanes 316, 318. The locking apparatus 300A therefore reaches a locking apparatus open position, as shown in FIG. 4F, where the sensing vane 330 and the fixed vane 340 are substantially parallel to one another, and are at the same or similar height, similar to in the locking apparatus unlocked position or the locking system unlocked position as shown in FIG. 4E. The distance between the sensing vane 330 and the fixed vane 340 is wider than in the intermediate position, and the distance between the third vertical arm 328 and the fourth vertical arm 336 is also wider than in the intermediate position. However, the elevator door latch arm 302 remains in the catch 304, with the shorting bar 303 still in contact with contacts 305.

Figure 5:
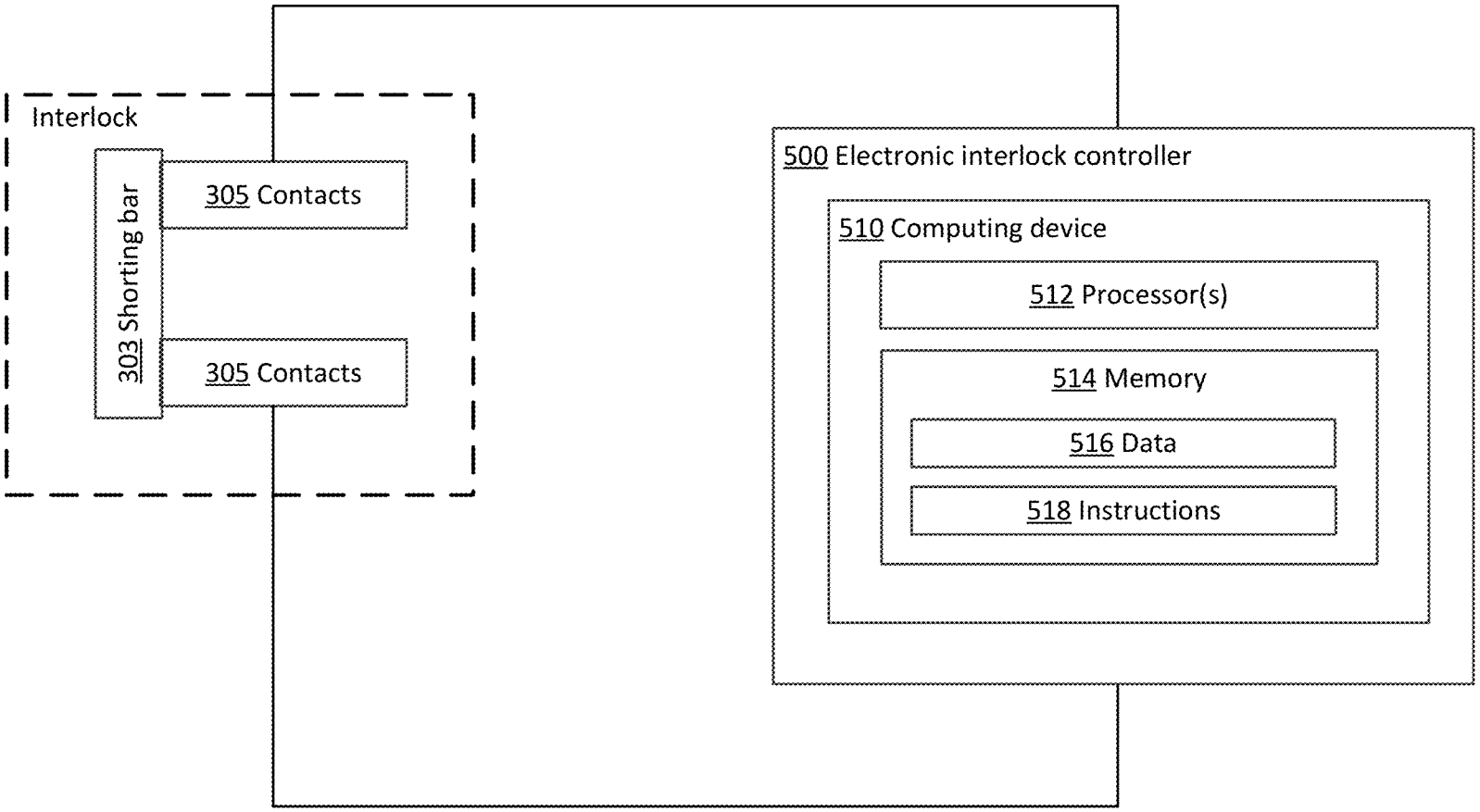
FIG. 5 is a functional diagram of an integrated electronic interlock controller 500 in accordance with aspects of the disclosure.

The locking system 300 also includes an electronic interlock, comprising the elevator door latch arm 302, shorting bar 303, catch 304, and at least two contacts 305, that provides an indication of whether the elevator car door 106 is locked or unlocked. As discussed above, the elevator door latch arm 302 includes the shorting bar 303 that is configured to contact the corresponding at least two contacts 305 at the catch 304 for elevator door latch arm. As shown in FIG. 5, when the shorting bar 303 is in contact with the at least two contacts 305, an electrical circuit including the contacts 305 may be completed, which may trigger a switch or otherwise change the circuit in a detectable manner, such as, for example, through a change in voltage or current. An electronic interlock controller 500, located either at the locking apparatus 300A or at least partially remotely from the locking apparatus 300A in another part of the elevator system 100, may detect the switch or other detectable circuit change. The electronic interlock controller 500 may determine whether the elevator car door 106 is improperly locked or improperly unlocked and send instructions to other portions of the elevator system accordingly. In some alternatives, the electronic interlock controller 500 may send an indication of the detected circuit change to a remote computing device, which may perform the determining and/or instruction sending functions.

As shown in FIG. 5, the electronic interlock controller 500 may include one or more computing devices 510. The one or more computing devices 510 may comprise one or more processors 512 and a memory 514. The one or more processors 512 may be any conventional processors, such as commercially available CPUs. Alternatively, the one or more processors may be a dedicated device such as an application specific integrated circuit (ASIC) or other hardware-based processor, such as a field programmable gate array (FPGA). Although FIG. 5 functionally illustrates the one or more processors 512 and memory 514 as being within the same block, it will be understood that the one or more processors 512 and memory 514 may actually comprise multiple processors and memories that may or may not be stored within the same physical housing. Accordingly, references to a processor or computer will be understood to include references to a collection of processors or computers or memories that may or may not operate in parallel.

Memory 514 stores information accessible by the one or more processors 512, including data 516 and instructions 518 that may be executed by the one or more processors 512. The memory may be of any type capable of storing information accessible by the processor, including a computer-readable medium such as a hard-drive, memory card, ROM, RAM, DVD or other optical disks, as well as other write-capable and read-only memories. The system and method may include different combinations of the foregoing, whereby different portions of the instructions and data are stored on different types of media.

Data 516 may be retrieved, stored or modified by the one or more processors 512 in accordance with the instructions 518. For instance, although the system and method is not limited by any particular data structure, the data 516 may be stored in computer registers, in a relational database as a table having a plurality of different fields and records, XML documents or flat files. The data 516 may also be formatted in any computer-readable format such as, but not limited to, binary values or Unicode. By further way of example only, image data may be stored as bitmaps comprised of grids of pixels that are stored in accordance with formats that are compressed or uncompressed, lossless (e.g., BMP) or lossy (e.g., JPEG), and bitmap or vector-based (e.g., SVG), as well as computer instructions for drawing graphics. The data 516 may comprise any information sufficient to identify the relevant information, such as numbers, descriptive text, proprietary codes, references to data stored in other areas of the same memory or different memories (including other network locations) or information that is used by a function to calculate the relevant data. Data may include threshold voltage and current amounts in a locking state circuit that indicates whether the elevator car door is locked or unlocked.

Instructions 518 may be any set of instructions to be executed directly (such as machine code) or indirectly (such as scripts) by the one or more processors 512. For example, the instructions 518 may cause the one or more processors 512 to detect a locking state of the elevator car door (i.e., whether the elevator car door is locked or unlocked), to transmit an indication of the locking state to a central controller, to keep the elevator car door close, to keep the elevator car stationary, or to perform another step. The instructions 518 may be stored as computer code on the computer-readable medium. In that regard, the terms "instructions" and "programs" may be used interchangeably herein. The instructions 518 may be stored in object code format for direct processing by the one or more processors 512, or in any other computer language including scripts or collections of independent source code modules that are interpreted on demand or compiled in advance. Functions, methods and routines of the instructions 518 are explained in more detail below.

In some examples, there is also an electronic interlock on the hoistway door, comprising the hoistway door latch arm 350, shorting bar 351, catch 352, and contacts 353, that functions similar to the electronic interlock on the elevator car door. In these examples, there may also be an electronic interlock controller on the hoistway side similar to the electronic interlock controller 500 described above.

Example Methods

Figure 6:
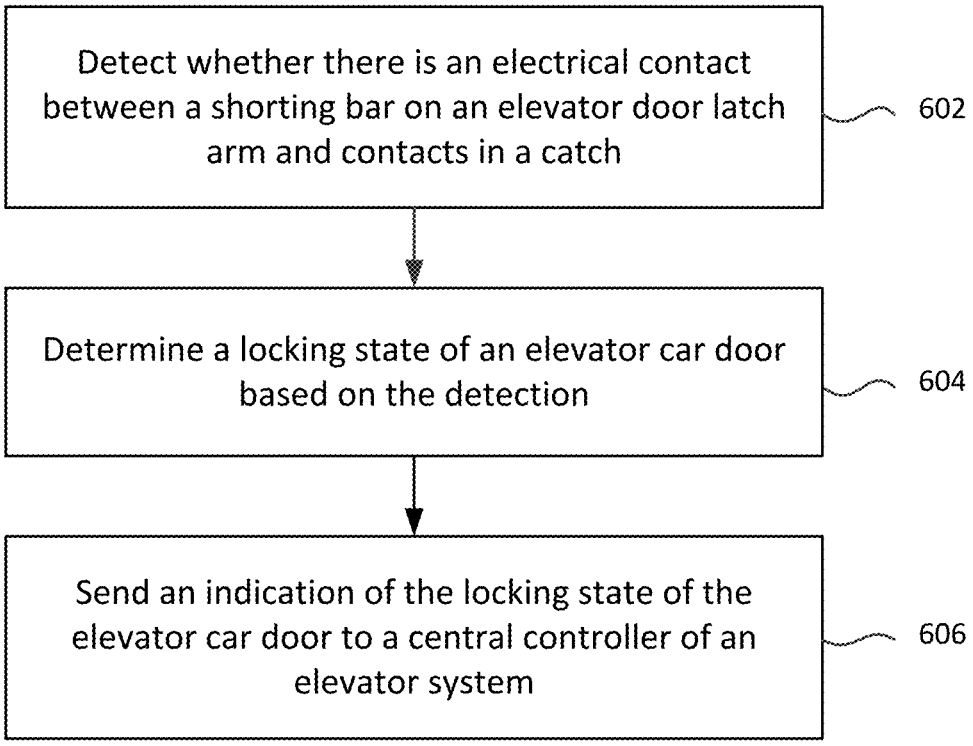
FIG. 6 is a flow diagram 600 of a method in accordance with aspects of the disclosure.

In FIG. 6, flow diagram 600 is shown in accordance with some of the aspects described above that may be performed by the one or more processors 512 of the electronic interlock controller 500. While FIG. 6 shows blocks in a particular order, the order may be varied and multiple operations may be performed simultaneously. Also, operations may be added or omitted.

At block 602, the one or more processors 512 may detect whether there is an electrical contact between the shorting bar 303 on the elevator door latch arm 302 and the contacts 305 in the catch 304. The detection may be made by receiving and identifying a current or a signal indicating that a locking state circuit that includes the contacts 305 is closed or open at the interlock. At block 604, the one or more processors 512 may determine whether the elevator car door 106 is locked or unlocked, or a locking state of the elevator car door, based on the detection. When the electrical contact is detected, the one or more processors 512 may determine the elevator car door 106 is locked. When the electrical contact is not detected, the one or more processors 512 may determine the elevator car door 106 is unlocked.

At block 606, the one or more processors 512 may send an indication of the locking state of the elevator car door to a central controller of the elevator system 100. The indication may be used with or without other information to make other determinations of the elevator car door 106 and decisions regarding how to operate the elevator system 100. For example, the indication may be used to determine whether the elevator car door 106 is closed or open. In other examples, the indication may be used to determine whether the elevator system 100 has malfunctioned or been compromised in some way by comparing the locking state indication to other indications for the elevator system 100. Decisions that may be made based on the indication may include whether to keep the elevator car door closed when the elevator car door 106 is determined to be unlocked in error, whether to close the elevator car door when the elevator car door has already been opened, whether to keep the elevator car stationary, or whether to apply brakes to cause the elevator car to be stationary when the elevator car is already in motion.

In another example, the blocks described above may additionally or alternatively be performed by an electronic interlock controller on the hoistway side that detects electrical contact at an interlock on the hoistway door.

The features described above may provide for an elevator system that more reliably ensures that both the elevator car door 106 and the hoistway door 108 are closed before moving an elevator car. Integrating the electronic interlock with the mechanical locking system means it is harder to bypass one independent of the other. In addition, using the features described, the unlocking of the elevator car door may be performed without moving the elevator car door. Elevator rides using the elevator system may therefore be safer and smoother.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A locking system for an elevator car door, the system comprising:

a locking apparatus configured to be mounted to the elevator car door, wherein the locking apparatus includes:

an elevator door latch arm having a distal end and a proximal end, the distal end being configured to be inserted into a catch to keep the elevator car door closed, the catch being in an installed position coupled to the elevator car door;

a sensing vane having a first inner surface and a first outer surface opposite the inner surface, the outer surface of the sensing vane being configured to engage with a first roller on a hoistway door when the elevator car door is in an alignment position with respect to the hoistway door; and a fixed vane that is generally parallel to the sensing vane, the fixed vane having a second inner surface that faces the first inner surface of the sensing vane and a second outer surface opposite the second inner surface of the fixed vane, the fixed vane being configured to engage with a second roller on the hoistway door;

wherein the locking apparatus is configured to remove the elevator door latch arm from the catch when the sensing vane is engaged with the first roller and the fixed vane is engaged with the second roller, and the locking apparatus is configured to insert the elevator door latch arm in the catch when the sensing vane becomes unengaged with the first roller and the fixed vane becomes unengaged with the second roller.

2. The locking system of claim 1, further comprising:

a shorting rod located on the distal end of the elevator door latch arm, the shorting rod being configured to contact at least two contacts located at the catch and close a circuit including the contacts when the distal end of the elevator door latch arm is inserted into the catch; and the at least two contacts located in the catch.

3. The locking system of claim 2, further comprising:

one or more processors configured to:

detect whether the circuit is closed or open;

determine a locking state of the elevator car door based on the detection; and send an indication of the locking state to a controller remote from the locking system.

4. The locking system of claim 1, further comprising an engagement apparatus, wherein the engagement apparatus includes the first roller and the second roller.

5. An apparatus that comprises:

an elevator door latch arm having a distal end and a proximal end, the distal end being configured to be inserted into a catch to keep an elevator car door closed, the catch being in an installed position coupled to the elevator car door;

a sensing vane having a first inner surface and a first outer surface opposite the inner surface, the outer surface of the sensing vane being configured to engage with a first roller on a hoistway door when the elevator car door is in an alignment position with respect to the hoistway door; and a fixed vane that is generally parallel to the sensing vane, the fixed vane having a second inner surface that faces the first inner surface of the sensing vane and a second outer surface opposite the second inner surface of the fixed vane, the fixed vane being configured to engage with a second roller on the hoistway door;

wherein the locking apparatus is configured to remove the elevator door latch arm from the catch when the sensing vane is engaged with the first roller and the fixed vane is engaged with the second roller, and the locking apparatus is configured to insert the elevator door latch arm in the catch when the sensing vane becomes unengaged with the first roller and the fixed vane becomes unengaged with the second roller.

6. The apparatus of claim 5, further comprising:

a shorting rod located on the distal end of the elevator door latch arm, the shorting rod being configured to contact at least two contacts located at the catch and close a circuit including the contacts when the distal end of the elevator door latch arm is inserted into the catch; and the at least two contacts located in the catch.

7. The apparatus of claim 6, further comprising:

one or more processors configured to:

detect whether the circuit is closed or open;

determine a locking state of the elevator car door based on the detection; and send an indication of the locking state to a controller remote from the locking system.

* * * * *